US006802241B2

(12) United States Patent
Kimura

(10) Patent No.: US 6,802,241 B2
(45) Date of Patent: Oct. 12, 2004

(54) AIR BALANCING DEVICE

(75) Inventor: Noboru Kimura, Nagoya (JP)

(73) Assignee: Hirotaka Engineering Ltd., Nagoya (JP)

( * ) Notice: Subject to any disclaimer, the term of this patent is extended or adjusted under 35 U.S.C. 154(b) by 184 days.

(21) Appl. No.: 10/258,401

(22) PCT Filed: May 1, 2001

(86) PCT No.: PCT/JP01/03784

§ 371 (c)(1),
(2), (4) Date: Oct. 23, 2002

(87) PCT Pub. No.: WO01/83358

PCT Pub. Date: Nov. 8, 2001

(65) Prior Publication Data

US 2003/0106421 A1 Jun. 12, 2003

(30) Foreign Application Priority Data

Apr. 28, 2000 (JP) ..... 2000-130052

(51) Int. Cl.[7] ..... F15B 11/028
(52) U.S. Cl. ..... 91/433; 91/390
(58) Field of Search ..... 91/390, 433

(56) References Cited

U.S. PATENT DOCUMENTS 5,644,966 A * 7/1997 Kimura ..... 91/433

FOREIGN PATENT DOCUMENTS

| | | |
|---|---|---|
| JP | 8-239200 | 9/1996 |
| JP | 9-301697 | 11/1997 |
| JP | 10-30609 | 2/1998 |

* cited by examiner

*Primary Examiner*—F. Daniel Lopez
(74) *Attorney, Agent, or Firm*—Davis & Bujold, P.L.L.C.

(57) ABSTRACT

A pressure regulating valve (20) for adjusting a pressure of a supply/discharge passage (10) to a pressure balanced against a weight of a body to be carried (1) is provided. The supply/discharge passage (10) is connected to a working chamber (8) of a cylinder (2) for raising and lowering the body to be carried (1). A control valve (38) for increasing and decreasing a pressure in a control passage (28) in accordance with a balance between the weight of the body to be carried (1) and a working force in a reaction force chamber (42) to which a pilot pressure is introduced from the control passage (28) is also provided. The pressure regulating valve (20) comprises a pressure regulating chamber (26) connected to the control passage (28) via an opening/closing valve (48), a pilot chamber (30) to which the pilot pressure from the control passage (28) is constantly introduced, and a control chamber (32) to which a pilot pressure from the supply/discharge passage (10), and it adjusts the pressure of the supply/discharge passage (10) to the pressure balanced against the weight of the body to be carried (1) by balancing a working force in the pressure regulating chamber (26) with working forces in the pressure chamber (30) and the control chamber (32).

3 Claims, 13 Drawing Sheets

AIR BALANCING DEVICE

TECHNICAL FIELD OF THE INVENTION

This invention relates to an air balancing device for hanging a body to be carried by balancing a load of the body to be carried against a supply pressure to a cylinder.

BACKGROUND OF THE INVENTION

Conventionally, as shown in the Unexamined Japanese Patent Publication No. 10-30609, an air balancing device is known in which a load of a body to be carried operates on a reaction force chamber partitioned by a diaphragm. Based on a pressure variance in a pressure chamber owing to a variance of the load, a main valve of the air balancing device is switched so that compressed air is supplied to a working chamber of a cylinder from a pressure source, or the working chamber is opened to the atmosphere, to control the pressure in the working chamber. Then, by balancing the load of the body to be carried with a working force in the cylinder, the body to be carried is hung.

However, in such a conventional device, the main valve does not open or close unless the volume of the working chamber is increased or decreased by overcoming sliding resistance of packing of the cylinder to slide a piston when the body to be carried is raised or lowered. Therefore, the operation for raising and lowering the body to be carried is heavy and difficult to be performed.

SUMMARY OF THE INVENTION

One object of the present invention is to provide an air balancing device which is easy to operate.

In order to attain the above object, the present invention provides an air balancing device for balancing a working force of a piston of a cylinder with a weight of a body to be carried, comprising a pressure regulating valve for adjusting a pressure in a supply/discharge passage to a pressure balanced against the weight of the body to be carried, the supply/discharge passage being connected to a working chamber of the cylinder for raising and lowering the body to be carried, the air balancing device further comprising a control valve for increasing and decreasing a pressure in a control passage in accordance with a balance between the weight of the body to be carried and a working force in a reaction force chamber to which a pilot pressure is introduced from the control passage, the pressure regulating valve comprising a pressure regulating chamber connected to the control passage via an opening/closing valve, a pilot chamber to which the pilot pressure from the control passage is constantly introduced, and a control chamber to which a pilot pressure from the supply/discharge passage is introduced, the pressure in the supply/discharge passage being adjusted to a pressure balanced against the weight of the body to be carried in accordance with a balance between a working force in the pressure regulating chamber and working forces in the pilot chamber and the control chamber.

The air balancing device may further comprise a leverage member rockably supported, to which the cylinder hanging the body to be carried is attached, wherein the pressure in said control passage is increased and decreased by bringing the working force in said reaction force chamber to operate on the leverage member to a direction counteracting the weight of the body to be carried, and also by opening and closing said control valve as a result of a rock of the leverage member. The air balancing device may further comprise a biasing member which is balanced with the weight of the cylinder.

DETAILED DESCRIPTION OF THE PREFERRED EMBODIMENT

The invention will now be described, by way of example, with reference to the accompanying drawings.

Figure 1:
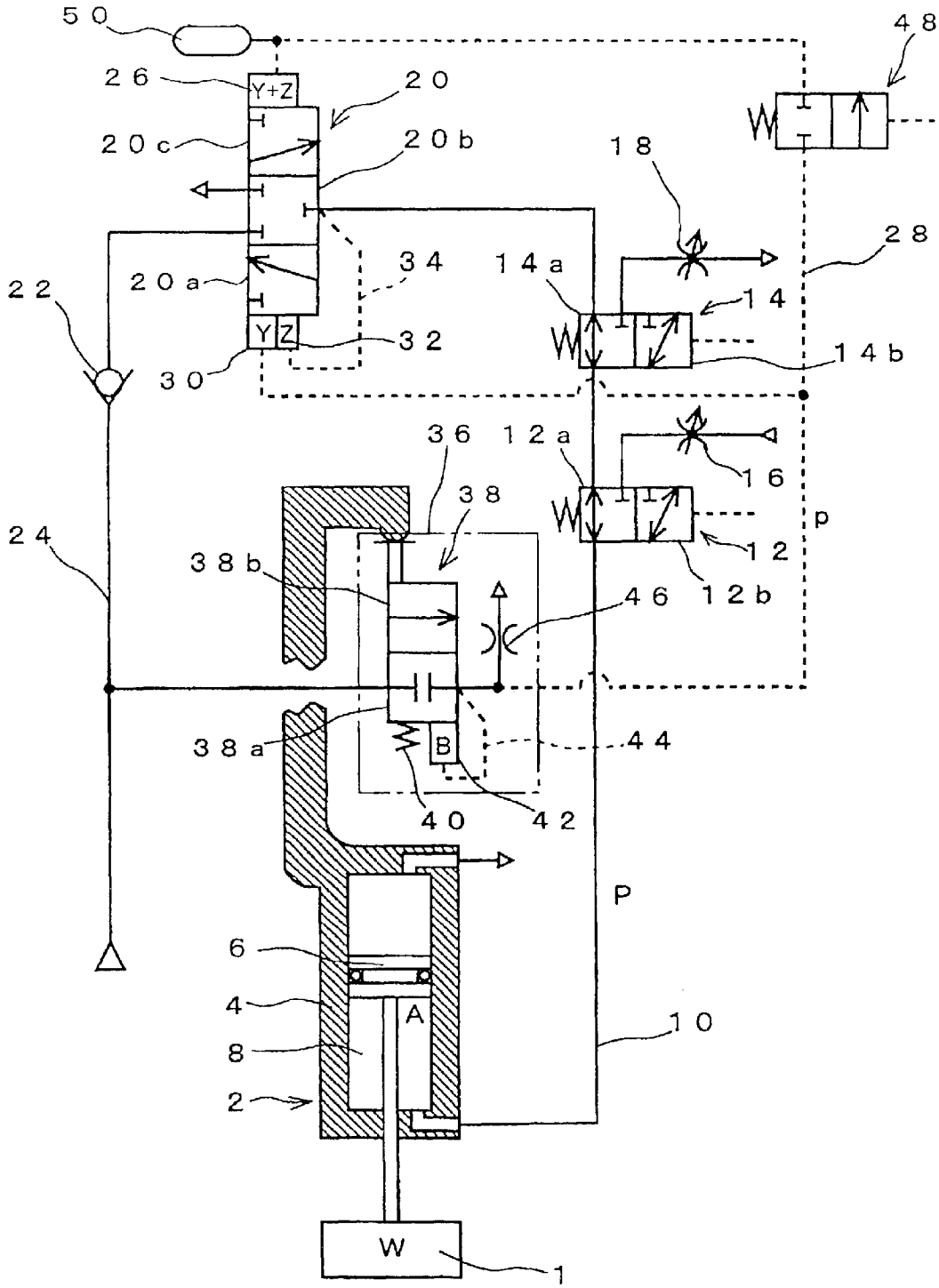
FIG. 1 is a diagrammatic representation of an air balancing device of an embodiment of the present invention.

As shown in FIG. 1, a reference number 1 denotes a body to be carried, which is hung from a cylinder 2. A piston 6 is slidably inserted to a cylinder tube 4 of the cylinder 2. As compressed air is supplied to a working chamber 8 formed by the cylinder tube 4 and the piston 6, a working force which raises the piston 6 is generated.

A supply/discharge passage 10 is connected to the working chamber 8, and a switching valve for ascent 12 and a switching valve for descent 14 are arranged on the supply/discharge passage 10. The switching valve for ascent 12 is provided with a communicating position 12*a* for communicating the supply/discharge passage 10 through, and an ascent position 12*b* for supplying the compressed air to the working chamber 8 via a variable throttle 16. The switching valve for descent 14 is provided with a communicating position 14*a* for communicating the supply/discharge passage 10 through, and a descent position 14*b* for releasing the compressed air to the atmosphere from the working chamber 8 via a variable throttle 18.

The other end of the supply/discharge passage 10 is connected to a pressure regulating valve 20, and the pressure regulating valve 20 is provided with an open position 20*a* for opening the supply/discharge passage 10 to the atmosphere, a hold position 20*b* for interrupting the supply/discharge passage 10, and a supply position 20*c* for connecting a high pressure passage 24 on which a check valve 22 is arranged to the supply/discharge passage 10.

The pressure regulating valve 20 can be switched by introduction of a pilot pressure. In the present embodiment, the pressure valve 20 is urged into the supply position 20*c* by a working force generated as a result of introduction of a pilot pressure p from a control passage 28 to a pressure regulating chamber 26 of which pressure receiving area is equal to X (=Y+Z). On the other hand, the pressure valve 20 is urged into the open position 20*a* by a working force generated as a result of introduction of the pilot pressure p from the control passage 28 to a pilot chamber 30 of which pressure receiving area is equal to Y and by a working force generated as a result of introduction of a pilot pressure P via a bypass passage 34 from the supply/discharge passage 10 to a control chamber 32 of which pressure receiving area is equal to Z.

The cylinder tube 4 is supported by a weight pneumatic converter 36. The weight pneumatic converter 36 comprises a control valve 38. The control valve 38 is provided with a closed valve position 38*a* for interruption between the high pressure passage 24 and the control passage 28, and an open valve position 38*b* for communication between the high pressure passage 24 and the control passage 28. The control valve 38 varies its opening range consecutively upon being switched from the closed valve position 38*a* to the open valve position 38.

The control valve 38 is urged into the open valve position 38*b* by the weight applied via the cylinder tube 4, and it is urged into the closed position 38*a* by biasing means such as a spring and a working force generated as a result of introduction of the pilot pressure p via a feedback passage 44 from the control passage 28 to a reaction pressure chamber 42 of which pressure receiving area is equal to B.

The control passage 28 is communicated with the atmosphere via a throttle valve 46, and a pilot opening/closing valve 48 is arranged on the control passage 28 so that it can interrupt introduction of the pilot pressure p to the pressure regulating chamber 26. An air tank 50 is connected so that it is communicated with the pressure regulating chamber 26 via the control passage 28.

Figure 2A:
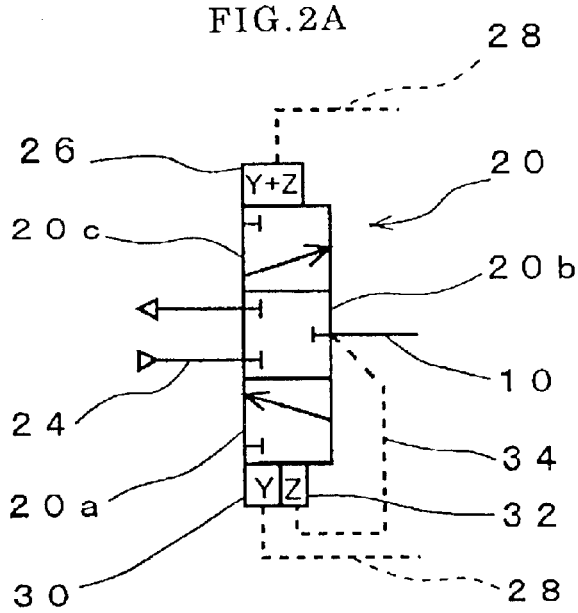
FIGS. 2A and 2B are explanatory diagrams showing a specific constitution of a pressure regulating valve of the first embodiment.
Figure 2B:
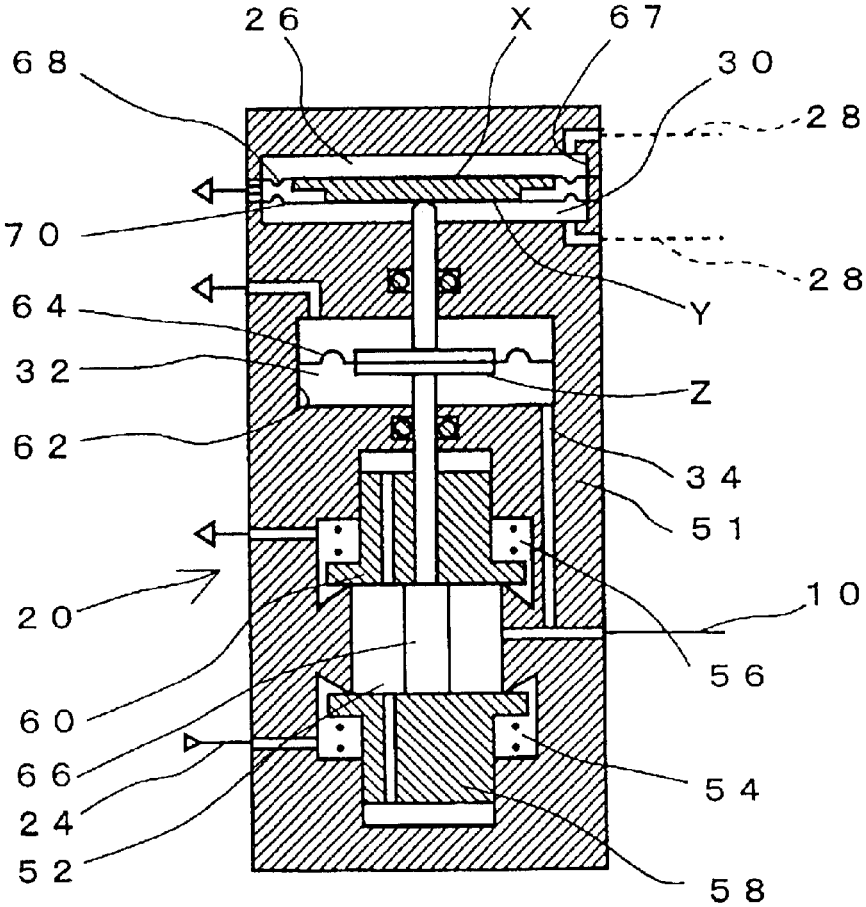

From now on, a first embodiment showing a specific constitution of the aforementioned pressure regulating valve 20 is explained by way of FIGS. 2A and 2B. FIG. 2A shows the pressure regulating valve 20 in JIS code, and FIG. 2B is a cross sectional view showing the specific constitution. FIGS. 3A–5B are illustrated in the same manner.

A valve body 51 of the pressure regulating valve 20 comprises a supply/discharge chamber 52, an air supply chamber 54, and an air discharge chamber 56. The supply/discharge passage 10 is connected to the supply/discharge chamber 52 of the pressure regulating valve 20, and the supply/discharge chamber 52 is communicated with the air supply chamber 54, which is connected to the high pressure passage 24.

The supply/discharge chamber 52 and the air supply chamber 54 can be communicated or interrupted by a slidably supported air supply valve element 58. The air discharge chamber 56 which is open to the atmosphere is communicated with the supply/discharge chamber 52, and the supply/discharge chamber 52 and the air discharge chamber 56 are communicated or interrupted by a slidably supported air discharge valve element 60.

A small hollow 62 is formed inside the valve body 51. The small hollow 62 is partitioned by a diaphragm 64, and a control chamber 32 is formed on one side of the diaphragm 64. The control chamber 32 is communicated with the supply/discharge chamber 52 via the bypass passage 34. A stem 66 which penetrates the air discharge valve element 60 is connected to the diaphragm 64 so that a pressure receiving area of the diaphragm 64 of the control chamber 32 is equal to Z.

A large hollow 67 is formed inside the valve body 51. The large hollow 67 is partitioned by a pair of first and second diaphragms 68, 70. A pressure regulating chamber 26 and a pilot chamber 30 are respectively formed on either side of the first and second diaphragms 68, 70.

The first diaphragm 68 is provided so that the pressure receiving area is equal to X, and the second diaphragm 70 is provided so that the pressure receiving area is equal to Y. In the present embodiment, the pressure receiving area X is larger than the pressure receiving area Y, and the pressure receiving area Y is larger than the pressure receiving area Z of the control chamber 32 (X>Y>Z). The pressure receiving area X is defined to be equal to a sum of the pressure receiving area Y and the pressure receiving area Z (X=Y+Z). The proportion between the pressure receiving areas X, Y and Z is not limited to the aforesaid proportion. It may be determined according to levels of fluid pressure introduced to the pressure regulating chamber 26, pilot chamber 30 and control chamber 32.

As the pilot pressure p introduced to the control chamber 32 from the supply/discharge passage 10 via the bypass passage 34 is applied to the diaphragm 64 having the pressure receiving area Z, the discharge valve element 60 is slid via the stem 66, and the supply/discharge chamber 52 and the air discharge chamber 56 are communicated.

A tip of the stem 66 is in contact with the first and second diaphragms 68, 70. As the pilot pressure p introduced to the pilot chamber 30 from the control passage 28 is applied to the second diaphragm 70 having the pressure receiving area Y, the discharge valve element 60 is slid via the stem 66, and the supply/discharge chamber 52 and the air discharge chamber 56 are communicated. On the other hand, as the pilot pressure p introduced to the regulating chamber 26 from the control passage 28 is applied to the first diaphragm 68, the air supply valve element 58 is slid via the stem 66, and the supply/discharge chamber 52 and the air supply chamber 54 are communicated.

Accordingly, when working forces in the control chamber 32 and the pilot chamber 30 surpass a working force in the pressure regulating chamber 26, the pressure regulating valve 20 is urged into the open position 20*a*, and when the working force in the pressure regulating chamber 26 surpasses the working forces in the control chamber 32 and the pilot chamber 30, the pressure regulating valve 20 is urged into the supply position 20*c*. When the working forces to both directions are evenly balanced, the pressure regulating valve 20 takes the hold position 20*b*.

An operation of the aforementioned air balancing device of the present embodiment is explained hereafter.

Firstly, under the condition that the body to be carried 1 is not hung, a biasing force of a biasing member 40 of the weight pneumatic converter 36 is adjusted so that, by a balance between a working force based on the weight of the cylinder 2 and the biasing force of the biasing member 40, the control valve 38 is urged into the closed valve position 38*a*, and, when the weight is increased even a little, the control valve 38 is urged into the open valve position 38*b* resulting in that the high pressure passage 24 and the control passage 28 are communicated via an opening.

The weight pneumatic pressure converter 36, as the weight on the cylinder 2 side is increased, is urged into the open valve position 38*b*. As a result, the communication opening between the high pressure passage 24 and the control passage 28 is widened, and the compressed air is released to the atmosphere via a throttle 46. The pilot pressure p in the control passage 28 is increased in proportion to the weight.

When the switching valve for descent 14 is switched to the descent position 14*b*, the compressed air in the working chamber 8 is released to the atmosphere via the supply/discharge passage 10, the switching valve for descent 14 and the variable throttle 18. The piston 6 is lowered to hang the body to be carried 1. Then, while the switching valve for descent 14 is switched to the communication position 14*a*, the switching valve for ascent 12 is switched to the ascent position 12*b*.

As a result, the compressed air is supplied to the working chamber 8 via the variable throttle 16, the switching valve for ascent 12 and the supply/discharge passage 10. Thereby, the body to be carried 1 is raised along with the piston 6. After the body to be carried 1 is raised to a predetermined height, the switching valve for ascent 12 is switched to the communication position 12*a*.

As a weight W of the body to be carried 1 is applied to the weight pneumatic pressure converter 36, the control valve 38 is switched to the open valve position 38*b*, and the pilot pressure p in the control passage 28 is increased. The control valve 38 is switched to a position of balance between the weight W of the body to be carried 1 and a sum of the biasing force of the biasing member 40 and the working force of the pilot pressure p introduced to the reaction force chamber 42 having the pressure receiving area B. At this point, a relation between the weight W, the pilot pressure p and the pressure receiving area B is represented by an equation: $p \times B = W$.

Furthermore, a pilot opening/closing valve 48 is opened so that the pilot pressure p in the control passage 28 is introduced to the pressure regulating chamber 26. The pilot pressure p in the control passage 28 is also introduced in the pilot chamber 30. The pilot pressure P from the supply/discharge passage 10 is introduced to the control chamber 32.

In the pressure regulating valve 20, the pilot pressure p from the control passage 28 is introduced to the pressure regulating chamber 26, and a working force to urge the pressure regulating valve 20 to the supply position 20*c* is generated. The pilot pressure p from the control passage 28 is also introduced to the pilot chamber 30, and a working force to urge the pressure regulating valve 20 to the open position 20*a* is generated. Additionally, the pilot pressure P from the supply/discharge passage 10 is introduced to the control chamber 32 via the bypass passage 34, and a working force to urge the pressure regulating valve 20 to the open position 20*a* is generated.

There is a relation which can be defined by an equation $X=Y+Z$ between the receiving areas X, Y and Z respectively of the pressure regulating chamber 26, the pilot chamber 30 and the control chamber 32. When the body to be carried 1 is balanced with the cylinder 2, a relational expression $P \times A = W$ is established where A is the pressure receiving area of the piston 6 and P is a pressure of the supply/discharge passage 10. If the pressure receiving area B of the reaction force chamber 42 is as large as the pressure receiving area A of the piston 6, the pilot pressure p in the control passage 28 and the pressure P in the supply/discharge passage 10 are equal to each other when the body to be carried is balanced with the cylinder 2.

In case that the pressure P in the supply/discharge passage 10 is lower than the pressure which is balanced with the body to be carried 1, the pressure regulating valve 20 is switched to the supply position 20*c* so that the compressed air is supplied to the working chamber 8 via the supply/discharge passage 10 from the high pressure passage 24. In case that the pressure P in the supply/discharge passage 10 is higher than the pressure which is balanced with the body to be carried 1, the pressure regulating valve 20 is switched to the open position 20*a* so that the compressed air is released to the atmosphere via the supply/discharge passage 10 from the working chamber 8.

When the pilot pressure p in the control passage 28 is equal to the pressure P in the supply/discharge passage 10, the working force in the pressure regulating chamber 26 is balanced with a sum of the working forces in the pilot chamber 30 and the control chamber 32, and the pressure regulating valve 20 is switched to the hold position 20*b*. When the pilot opening/closing valve 48 is closed under this condition, the pilot pressure p at the point is accumulated in the pressure regulating chamber 26 and the air tank 50.

As the body to be carried 1 is raised, the weight applied to the control valve 38 is decreased so that the control valve 38 is switched to the closed valve position 38*a*. Thereby, the compressed air is released to the atmosphere via the throttle 46 from the control passage 28, and the pilot pressure p in the control passage 28 is decreased. The pilot pressure p introduced to the pilot chamber 30 is also decreased, and the pressure regulating valve 20 is switched to the supply position 20*c* so that the high pressure passage 24 and the supply/discharge passage 10 are communicated. The compressed air is supplied to the working chamber 8 via the supply/discharge passage 10, and raising the body to be carried 1 is assisted.

When the body to be carried 1 is stopped to be raised, the weight W of the body to be carried 1 is applied to the control valve 38 so that the control valve 38 is switched to the open valve position 38*b*. Thereby, the compressed air is supplied to the control passage 28 from the high pressure passage 24, and the pilot pressure p is increased. In the control valve 38, this pilot pressure p is introduced to the reaction force chamber 42, and the opening of the control valve 38 is determined according to the point where the weight W of the body to be carried 1 is balanced with a sum of the biasing force of the biasing member 40 and the working force in the reaction force chamber 42.

The pressure regulating valve 20 is switched to the open position 20*a* as the pilot pressure p introduced to the pilot chamber 30 is increased. As a result, the compressed air is released to the atmosphere from the supply/discharge passage 10. As the working force in the pressure regulating chamber 26 having the accumulated pilot pressure p is balanced with a sum of the working forces in the pilot chamber 30 and in the control chamber 32, the pressure regulating valve 20 is switched to the hold position 20*b*, resulting in that the working force in the working chamber 8 is balanced with the weight W of the body to be carried 1.

As the body to be carried 1 is pushed down, the control valve 38 is switched to the open valve position 38*b*. As a result, the compressed air is supplied to the control passage 28 from the high pressure passage 24, and the pilot pressure p is increased. This pilot pressure p is introduced to the pilot chamber 30 so that the pressure regulating valve 20 is switched to the open position 20*a*. The working chamber 8 is communicated with the atmosphere via the supply/discharge passage 10, and the compressed air is released. The pressure inside the working chamber 8 is declined, and the body to be carried 1 is lowered due to its own weight.

As the body to be carried 1 is stopped to be lowered, the weight applied is decreased. As a result, the control valve 38 is switched to the closed valve position 38*a*, and the pilot pressure p of the control passage 28 is decreased. In the control valve 38, this pilot pressure p is introduced to the reaction force chamber 42, and the opening of the control valve 38 is determined according to the point where the weight W of the body to be carried 1 is balanced with a sum of the biasing force of the biasing member 40 and the working force in the reaction force chamber 42.

As the working force in the pilot chamber 30 to which this pilot pressure p is introduced is decreased, the pressure regulating valve 20 is switched to the supply position 20*c*. As a result, the compressed air is supplied to the working chamber 8 via the supply/discharge passage 10 from the high pressure passage 24. When a sum of the working forces in the pilot chamber 30 to which the pilot pressure p is introduced and in the control chamber 32 is balanced with the working force in the pressure regulating chamber 26, the pressure regulating valve 20 is switched to the hold position 20*b* and the body to be carried 1 is retained.

As above explained, in the aforementioned air balancing device, in order to assist in raising and lowering the body to be carried 1, the compressed air is transformed into the pilot pressure p in the control passage 28 by the control valve 38 and the throttle 46, and then the pressure regulating valve 20 is switched so that the pilot pressure p in the control passage 28 is transformed into the same pressure with high flow volume in the supply/discharge passage 10. Accordingly, it is possible to operate the body to be carried 1 without being affected by sliding resistance of the packing etc. of the piston 6.

Figure 3A:
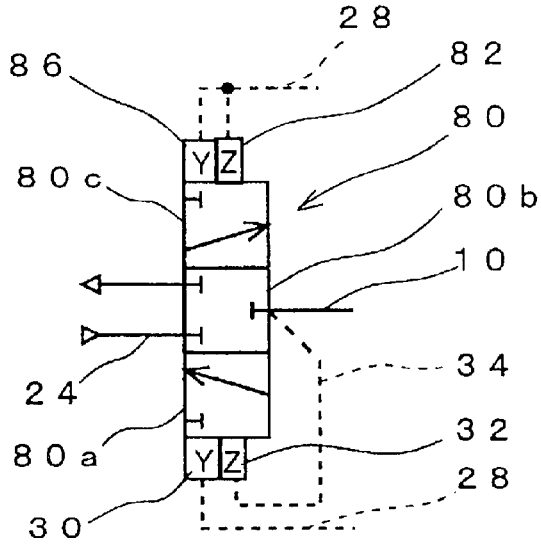
FIGS. 3A and 3B are explanatory diagrams showing a specific constitution of a pressure regulating valve of the second embodiment.
Figure 3B:
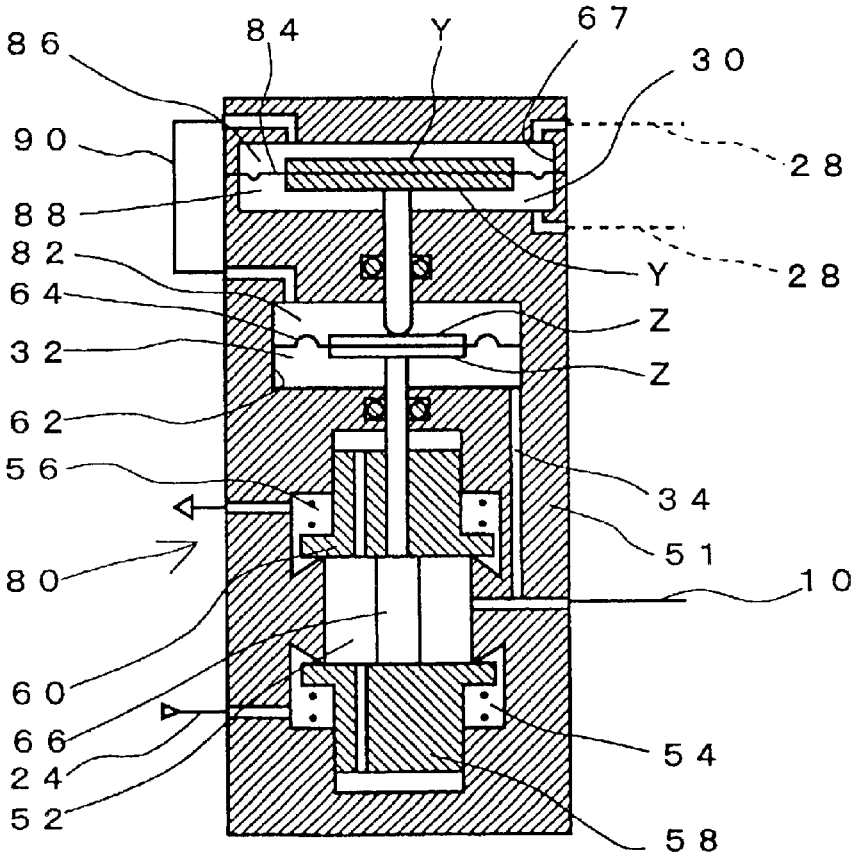

Now, a pressure regulating valve 80 of the second embodiment which is different from the pressure regulating valve 20 of the aforementioned first embodiment is explained by way of FIGS. 3A and 3B. The same components with those in the aforementioned first embodiment are represented using the same reference numbers and the detailed descriptions thereof are omitted. The same conditions apply to the other figures.

The pressure regulating valve 80 in the second embodiment partitions the small hollow 62 into the control chamber 32 and a second pressure regulating chamber 82 by means of the diaphragm 64. The control chamber 32 and the second pressure regulating chamber 82 have the same-sized receiving area Z. At the same time, the pressure regulating valve 80 partitions the large hollow 67 into a first pressure regulating chamber 86 and a pilot chamber 88. The first pressure regulating chamber 86 and the pilot chamber 88 have the same-sized receiving area Y. The first pressure regulating chamber 86 and the second pressure regulating chamber 82 are communicated via a connection passage 90. The pressure regulating valve 80 in the second embodiment operates in the same manner as the pressure regulating valve 20 in the first embodiment.

Figure 4A:
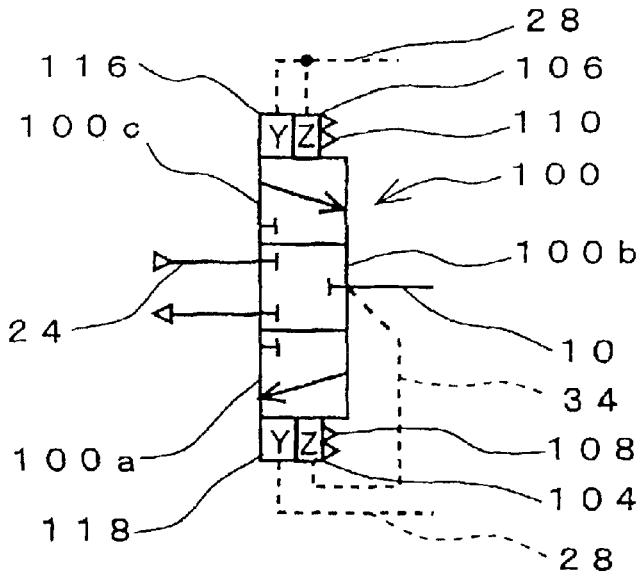
FIGS. 4A and 4B are explanatory diagrams showing a specific constitution of a pressure regulating valve of the third embodiment.
Figure 4B:
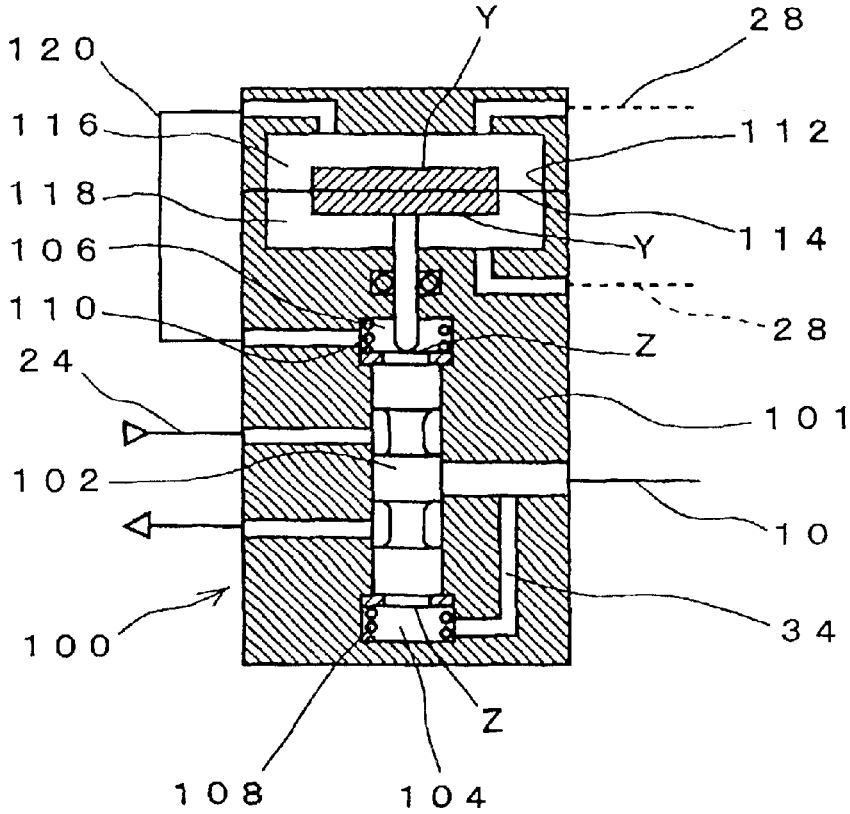

A pressure regulating valve 100 in the third embodiment is explained by way of FIGS. 4A and 4B.

A valve body 101 of the pressure regulating valve 100 comprises a spool 102 slidably supported thereto. According to the sliding of the spool 102, connection and disconnection between the supply/discharge passage 10 and the high pressure passage 24, and also between the supply/discharge passage 10 and the atmosphere are performed.

In the ends of the spool 102, a control chamber 104 and a second pressure regulating chamber 106 are respectively formed. According to a pilot pressure introduced to the control chamber 104 and the second pressure regulating chamber 106, a working force for sliding the spool 102 is generated. The control chamber 104 and the second pressure regulating chamber 106 are respectively formed to have the pressure receiving area Z.

The control chamber 104 and the second pressure regulating chamber 106 contain coiled springs 108, 110, respectively. The coiled springs 108 and 110 bias the spool 102 from both sides so that the spool 110 is adapted to a hold position which will be explained later. The coiled springs 108 and 110 are not necessarily provided.

A large hollow 112 is formed in the valve body 101. The large hollow 112 is partitioned by a diaphragm 114, and a first pressure regulating chamber 116 and a pilot chamber 118 are formed on the respective sides of the diaphragm 114. The spool 102 is slid by a pilot pressure introduced to the first pressure regulating chamber 116 and the pilot chamber 118 via a stem.

The first pressure regulating chamber 116 and the pilot chamber 118 have the same pressure receiving area Y. The control passage 28 is connected via the pilot opening/closing valve 48 to the first pressure regulating chamber 116, to which the second pressure regulating chamber 106 is connected via a communication passage 120. The control passage 28 between the pilot opening/closing valve 48 and the control valve 38 is connected to the pilot chamber 118. The control chamber 104 is connected to the supply/discharge passage 10 via the bypass passage 34.

In the pressure regulating valve 100 of the third embodiment as well, the pressure regulating valve 100 is switched to the supply position 100*a* by the accumulated pilot pressure p from the control passage 28 introduced to the first pressure regulating chamber 116 and the second pressure regulating chamber 106. Furthermore, the pressure regulating valve 100 is switched to the discharge position 110*c* by the pilot pressure P from the supply/discharge passage 10 introduced to the control chamber 104 and by the pilot pressure p from the control passage 28 introduced to the pilot chamber 118. When both working forces are balanced, the pressure regulating valve 100 is switched to the hold position 100*b*.

Figure 5A:
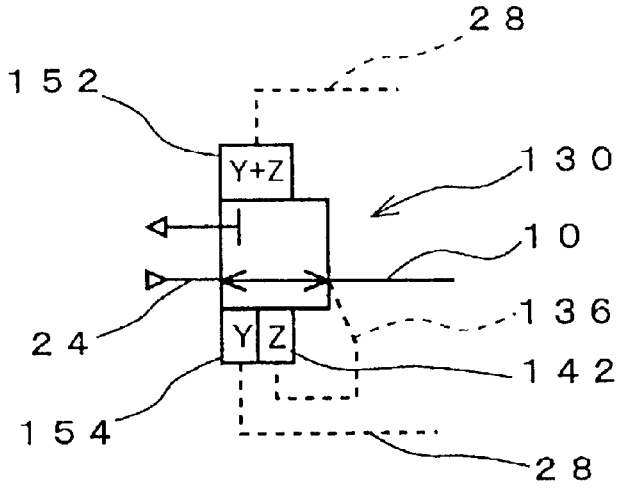
FIGS. 5A and 5B are explanatory diagrams showing a specific constitution of a pressure regulating valve of the fourth embodiment.
Figure 5B:
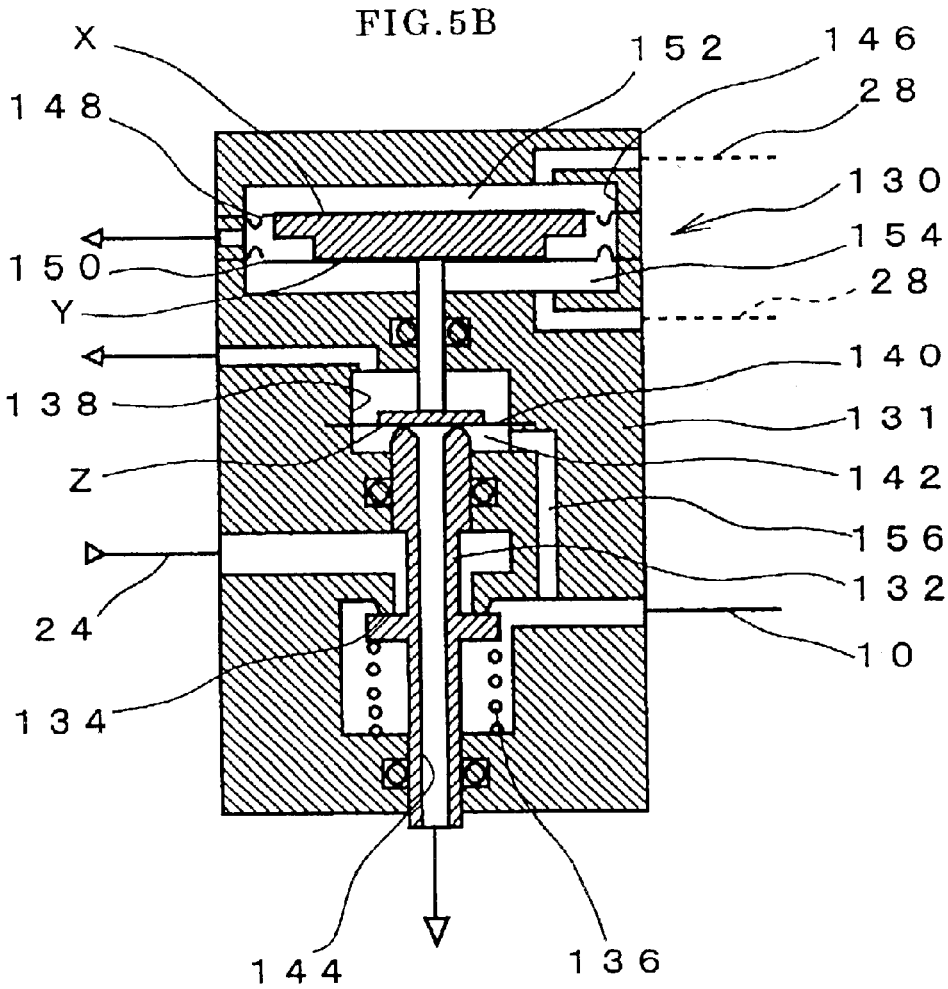

A pressure regulating valve 130 of the fourth embodiment is hereafter explained by way of FIGS. 5A and 5B.

The pressure regulating valve 130 is a so-called high relief pressure reducing valve. A valve element 132 is slidably supported to a valve body 131. The valve element 132 can perform disconnection and connection between the high pressure passage 24 and the supply/discharge passage 10 by sitting to and being away from a valve seat 134 formed in the valve body 131. The valve body 132 is biased to sit on the valve seat 134 by coiled springs 136.

A small hollow 138 is formed in the valve body 131. The small hollow 138 is partitioned by a diaphragm 140 and a control chamber 142 is formed on one side of diaphragm 140. A tip of the valve element 132 projects into the control chamber 142, and a rear end of the valve element 132 projects to the outside of the valve body 131.

A discharge hole 144 is piercingly formed through the valve element 132 to the axial direction. The discharge hole 144 enables the control chamber 142 to be communicated with the atmosphere. The tip of the valve element 132 is in contact with the diaphragm 140 so that the discharge hole 144 can be closed and opened. The pressure receiving area of the diaphragm 140 in the control chamber 142 is Z.

A large hollow 146 is formed in the valve body 131. The large hollow 146 is partitioned by a pair of first and second diaphragms 148 and 150. There are a pressure regulating chamber 152 and a pilot chamber 154 on the respective sides of the first and second diaphragms 148, 150.

The pressure receiving area of the first diaphragm 148 is X (=Y+Z). The pressure receiving area of the second diaphragm 150 is Y. The relation between each of the pressure receiving areas X, Y and Z is the same as in the pressure regulating valve 20 of the first embodiment.

The pressure regulating chamber 152 is connected to the control passage 28. The pressure regulating chamber 152 is connected to and disconnected from the control passage 28 by opening/closing of the pilot opening/closing valve 48. The pilot chamber 154 is connected to the control passage 28 between the pilot opening/closing valve 48 and the control valve 38. The control chamber 142 is connected to the supply/discharge passage 10 via a bypass passage 156.

In the pressure regulating valve 130 of the fourth embodiment as well, the pressure regulating valve 130 is operated by the pilot pressure p introduced to the pressure regulating chamber 152, so that the high pressure passage 24 and the supply/discharge passage 10 are communicated. The pressure regulating valve 130 is also operated by the pilot pressure p introduced to the pilot chamber 154 and the pilot pressure P introduced to the control chamber 142, so that the supply/discharge passage 10 is communicated with the atmosphere.

Figure 6A:
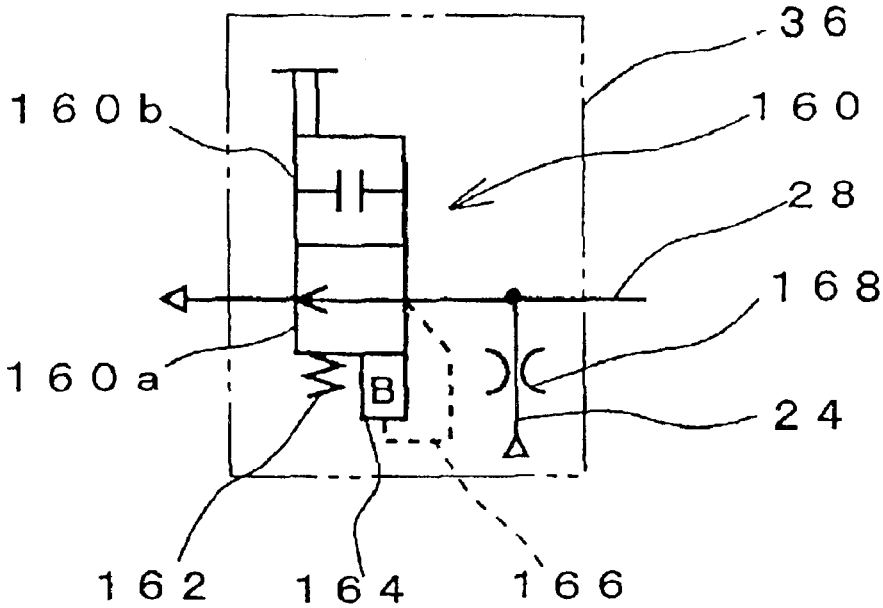
FIGS. 6A and 6B are explanatory diagrams of a control valve of another embodiment.
Figure 6B:
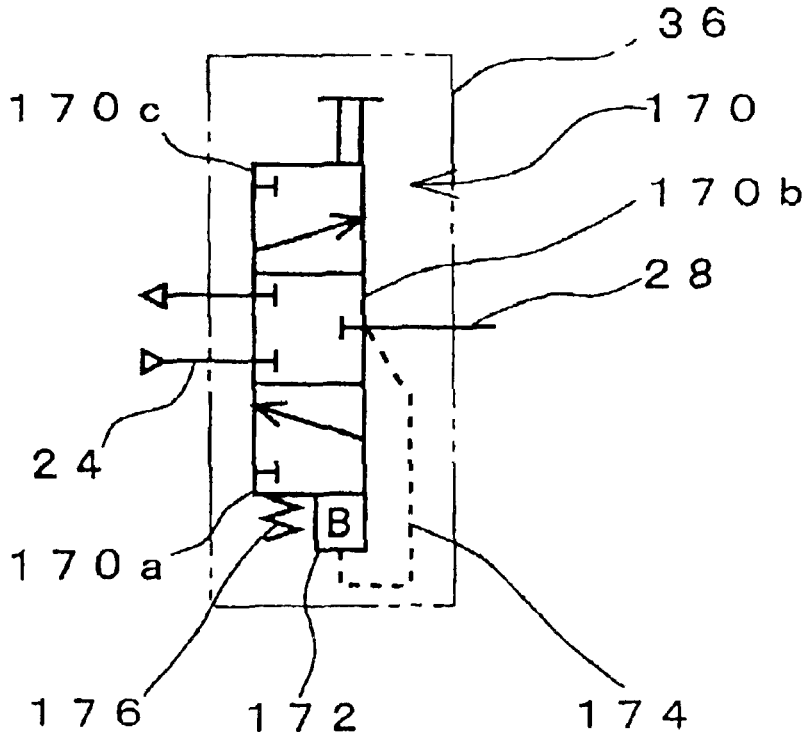

Now, another embodiment of the aforementioned weight pneumatic converter 36 is explained by way of FIGS. 6A and 6B.

The weight pneumatic converter 36 may not comprise the aforementioned control valve 38, but a control valve 160 as shown in FIG. 6A. The control valve 160 is provided with an open valve position 160*a* for opening the control passage 28 to the atmosphere and a closed valve position 160*b* for interrupting the control passage 28.

The weight applied to the control valve 160 via the cylinder 2 urges the control valve 160 to the closed valve position 160*b*, and a biasing force of a biasing member 162 and a working force of the pilot pressure P introduced from the control passage 28 to a reaction force chamber 164 via a feedback passage 166 urge the control valve 160 to the open valve position 160*a*. The high pressure passage 24 is connected to the control passage 28 via a throttle 168.

The control valve 160, as the weight is increased, is switched to the closed valve position 160*b*, and thereby the compressed air is supplied to the control passage 28 via the throttle 168 from the high pressure passage 24. On the other hand, as the weight is decreased, the control valve 160 is switched to the open valve position 160*a* by the biasing member 162 and the reaction force chamber 164 so that the control passage 28 is communicated with the atmosphere, thereby decreasing the pressure in the control passage 28.

A control valve 170 as shown in FIG. 6B can be also used in the weight pneumatic converter 36.

The control passage 28 and the high pressure passage 24 are connected to the control valve 170. The control valve 170 is provided with a discharge position 170*a* for opening the control passage 28 to the atmosphere, a hold position 170*b* for interrupting the control passage 28, and a supply position 170*c* for communicating the control passage 28 with the high pressure channel 24.

The weight applied to the control valve 170 urges the control valve 170 to the supply position 170*c*, and the pilot pressure p via a feedback passage 174 from the control passage 28 introduced to a reaction force chamber 172 having the pressure receiving area B urges the control valve 170 to the discharge position 170*a*. A biasing member 176 which is balanced with the weight of the cylinder 2 is provided. Therefore, when the weight of the body to be carried 1 is balanced with a working force in the reaction force chamber 172, the control valve 170 is switched to the hold position 170*b*. In this case as well, the pilot pressure p corresponding to the applied weight is generated in the control passage 28.

Figure 7:
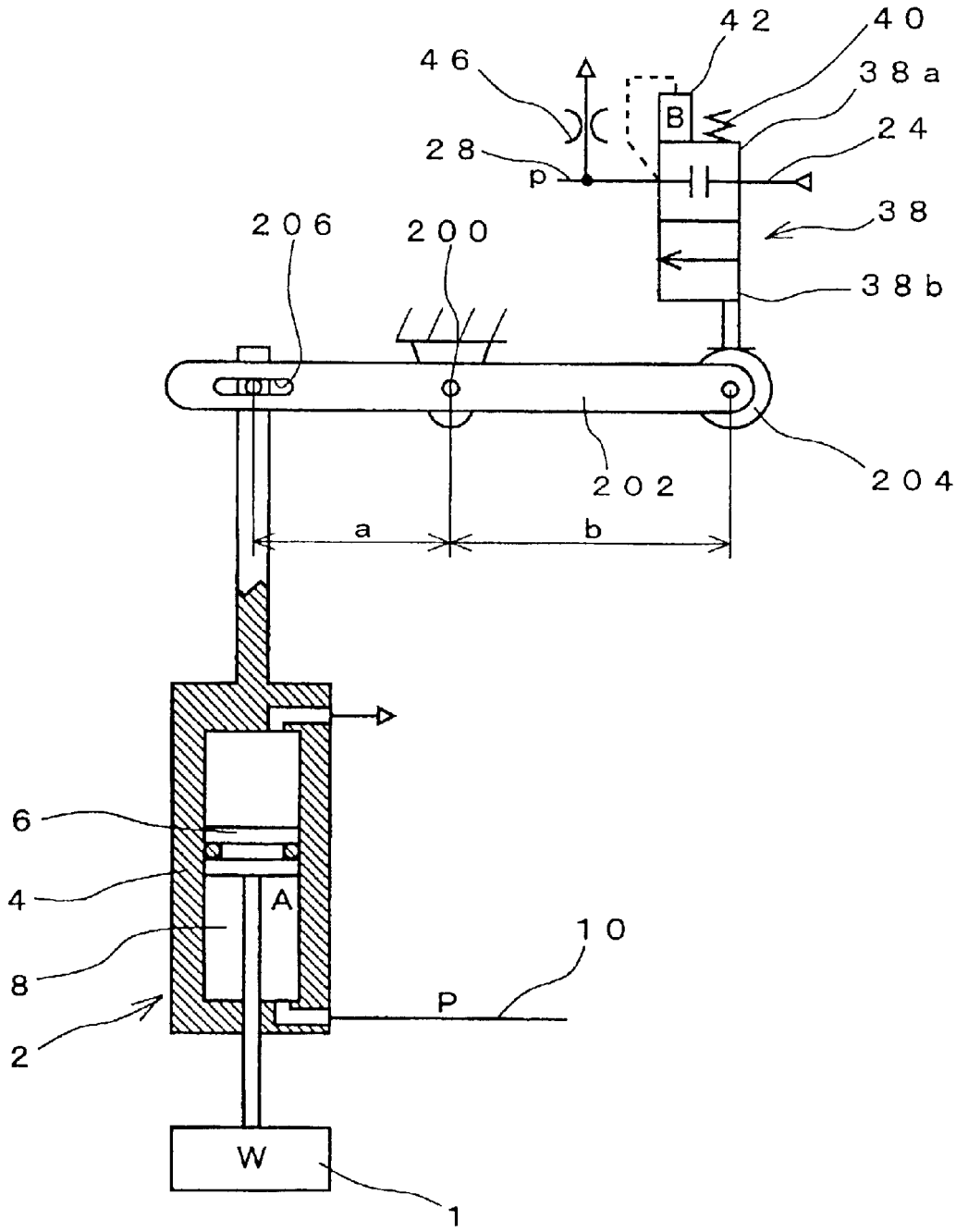
FIG. 7 is a diagrammatic representation of an air balancing device comprising a lever member of another embodiment.

Furthermore, the cylinder 2 may be hung at an end of a leverage member 202 which is supported rockably around a fulcrum pin 200, as shown in FIG. 7, without having the weight of the cylinder 2 and the body to be carried 1 be directly applied to the control valve 38. A roller 204 may be rotatably supported at the other end of the leverage member 202 so that the weight of the cylinder 2 and the body to be carried 1 is applied to the control valve 38 via the roller 204. In this case, an elongate hole 206 may be formed in the leverage member 202 so that a position of the cylinder 2 to be hung can be adjusted.

The distance between the fulcrum pin 200 and the hanging center of the cylinder 2 is represented by a, and the distance between the fulcrum pin 200 and the center of the roller 204 is represented by b. In this case, the following relation is established between the weight W of the body to be carried 1 and a working force in the reaction force chamber 42.

$$(a/b)\times W=p\times B$$

The pressure receiving area A of the piston 6 is formed so that an equation A=(b/a)×B is established. If the pilot pressure p introduced to the reaction force chamber 42 is equal to the pressure P in the working chamber 8 (p=P), the weight W is balanced with the working force in the reaction force chamber 42 when W=AP. In other words, even if the pressure receiving area A of the piston 6 is not equal to the pressure receiving area B in the reaction force chamber 42, detection of the weight applied is possible.

Figure 8:
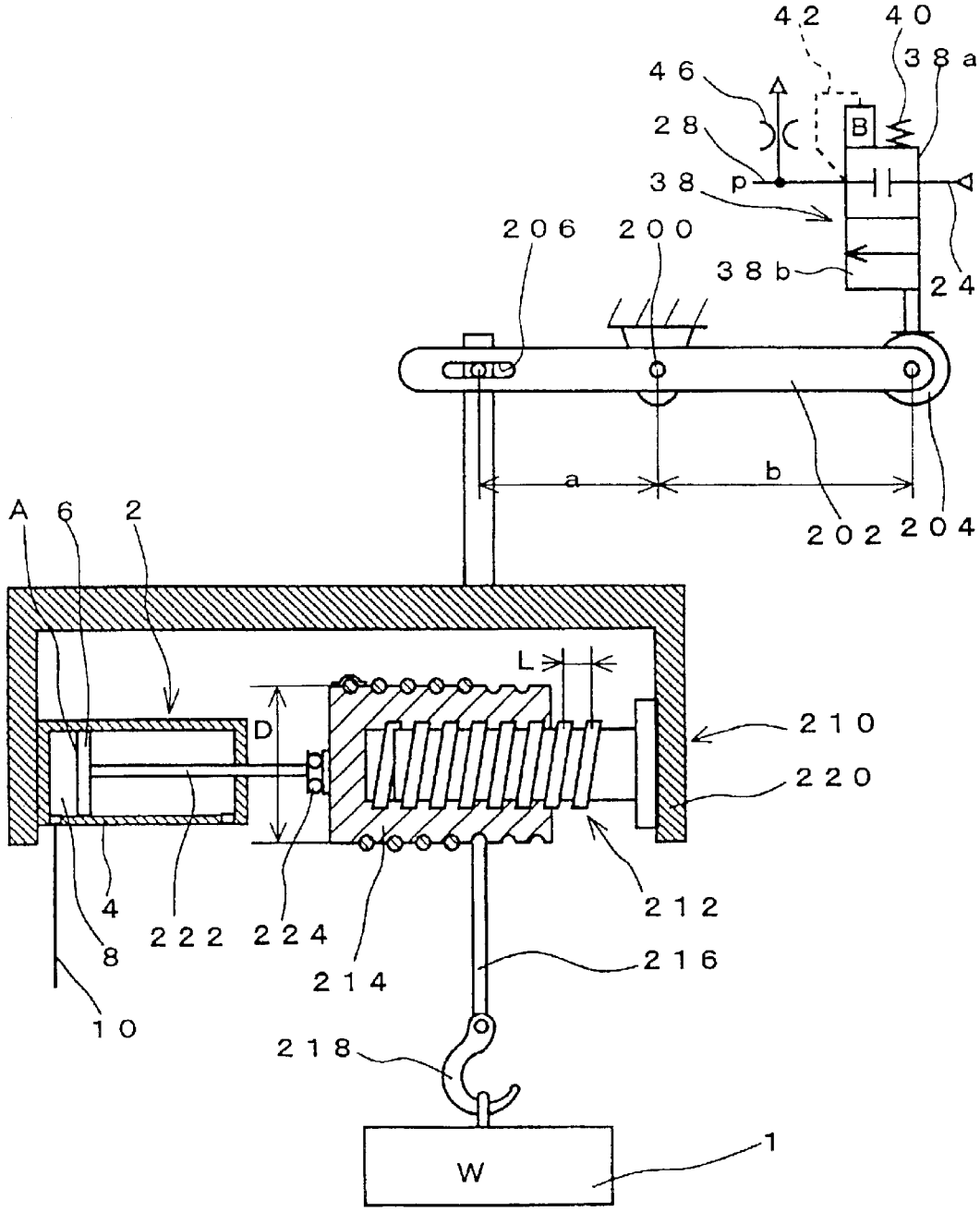
FIG. 8 is a diagrammatic representation of an air balancing device comprising a speed increasing mechanism of another embodiment.

As shown in FIG. 8, the air balancing device may be provided with a speed up mechanism 210. The speed up mechanism 210 uses a screw mechanism 212 which hangs the body to be carried 1 via a hook 218 attached to a tip of a wire 216 with which a drum 214 is wound. The cylinder tube 4 is attached to a frame 220 supported to the leverage member 202, and a rod 222 is attached to the drum 214 via a thrust bearing 224. If L is taken for a lead of the screw and D is taken for a drum pitch radius, the following equation is established. When the speed up mechanism 210 is used, acceleration occurs by an operation of the cylinder.

$$B=(L/\pi D)\times(a/b)\times A$$

Figure 9:
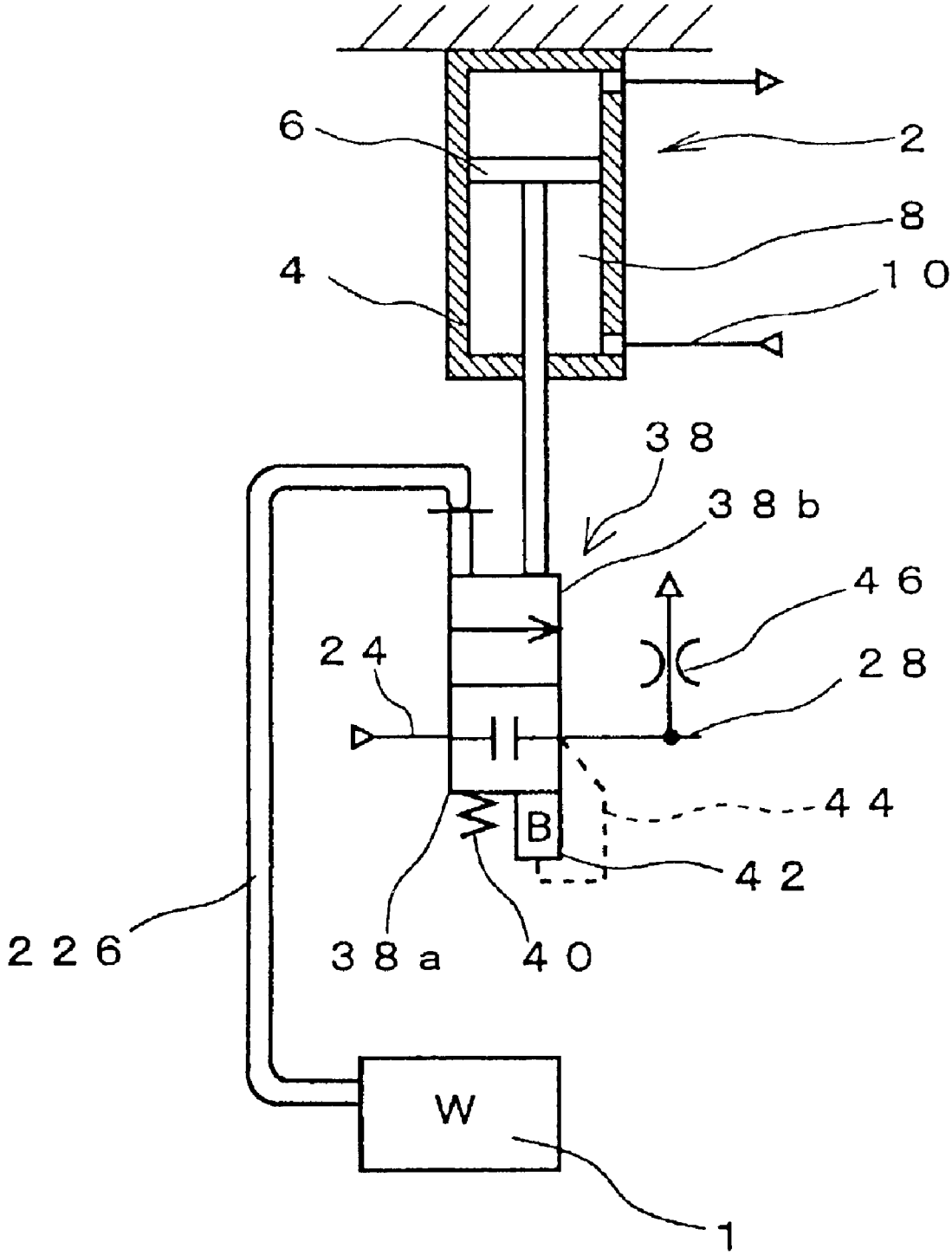
FIG. 9 is a diagrammatic representation of an air balancing device comprising a cylinder fixed thereto of another embodiment.

As shown in FIG. 9, the cylinder tube 4 is fixed to a base, and the valve body 51 of the control valve 38 is fixed to a rod of the cylinder 2 so that the weight of the body to be carried 1 is applied to the control valve 38 via a hanging member 226. In this manner, it is possible to raise and lower the control valve 38 along with the body to be carried 1.

Figure 10:
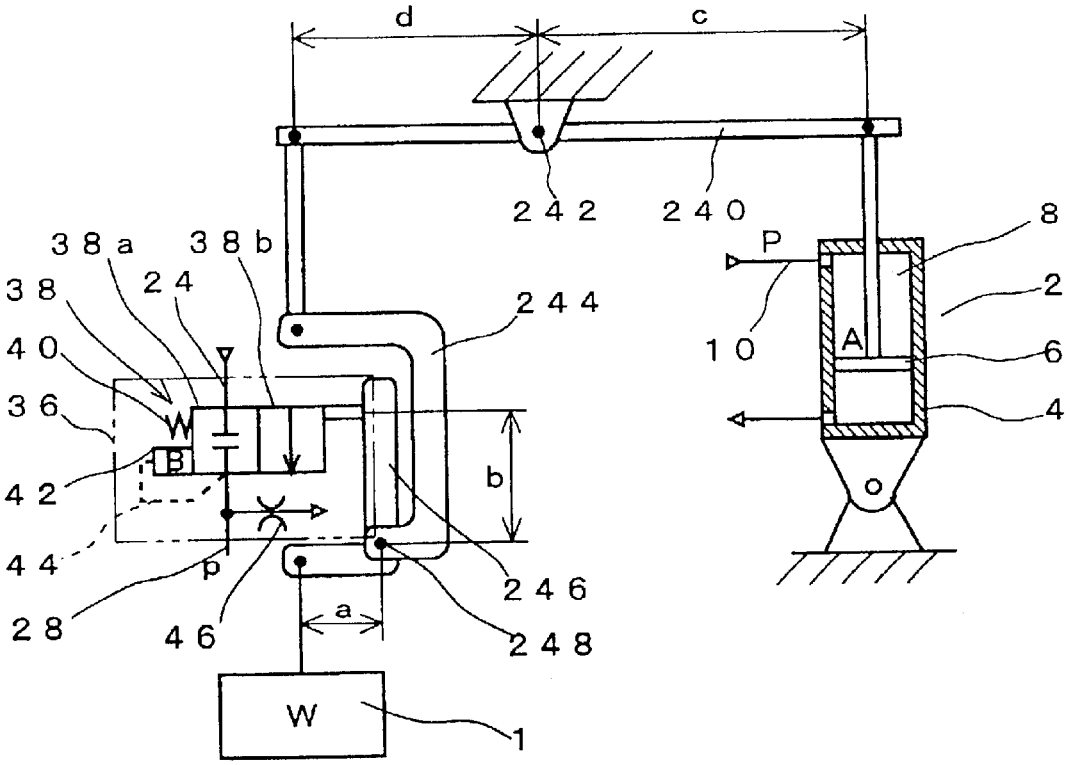
FIG. 10 is a diagrammatic representation of an air balancing device comprising a cylinder fixed thereto and a lever member of another embodiment.

As shown in FIG. 10, the leverage member 240 is supported rockably around the fulcrum pin 242. The rod of the cylinder 2 which has the cylinder tube 4 fixed to a base is connected to one end of the leverage member 240. A supporting member 244 is hangingly supported to the other end of the leverage member 240.

In the supporting member 244, a lever member 246 is supported rockably around a fulcrum pin 248. The body to be carried 1 is hung from one end of the lever member 246 and the weight pneumatic converter 36 is arranged at the other end thereof. In the same constitution, the weight pneumatic converter 36 may be arranged on the side where raising and lowering of the body to be carried 1 is performed.

Figure 11:
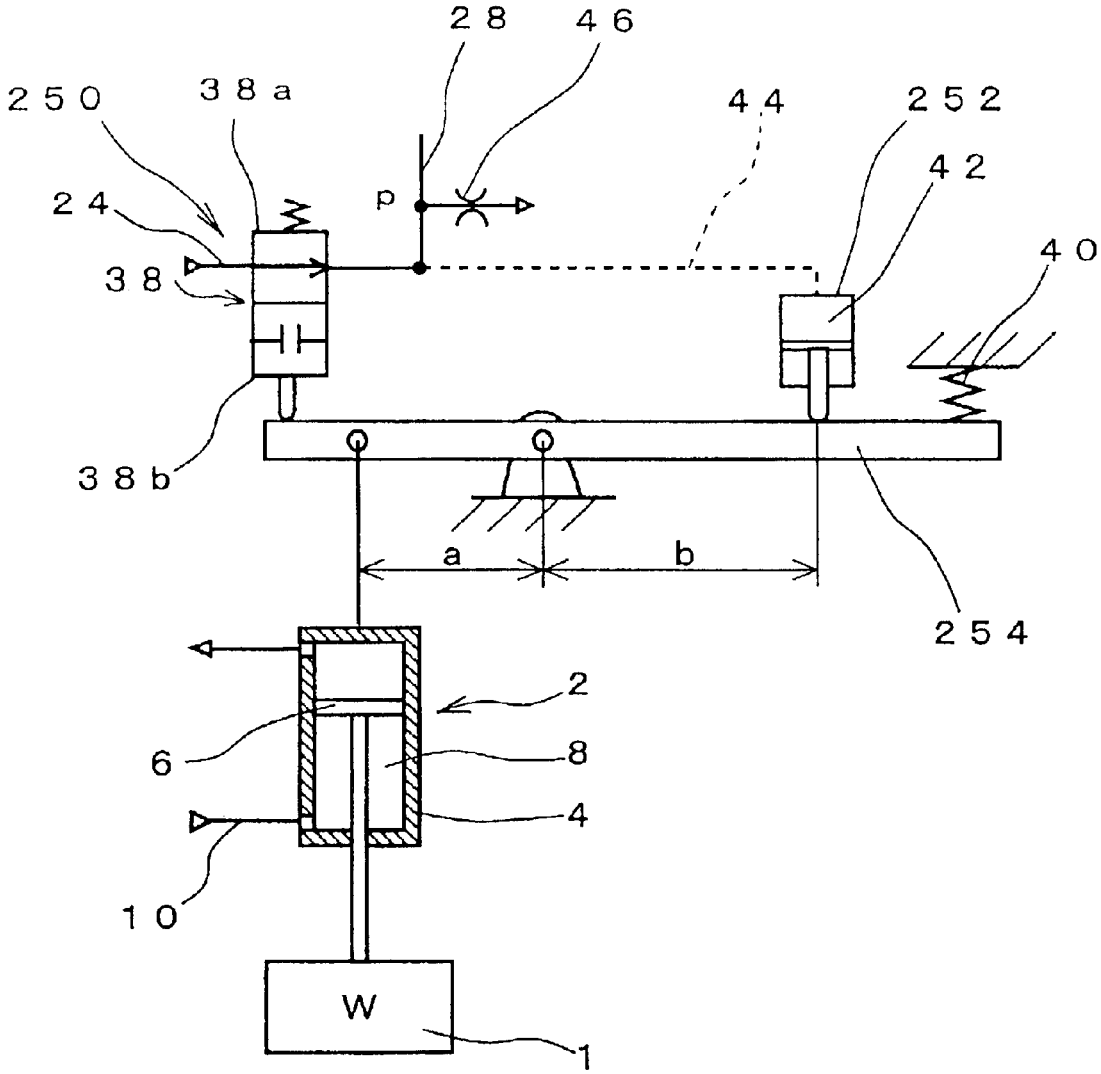
FIG. 11 is a diagrammatic representation of a relevant part of an air balancing device comprising a weight pressure converter of another embodiment.

In addition, a weight pressure converter 250 as shown in FIG. 11 may be used. The weight pressure converter 250 comprises a leverage member 254 supported rockably around a fulcrum pin 252, and the cylinder 2 is hangingly supported to the leverage member 254. In the weight pressure converter 250, the control valve 38, a reaction force mechanism 252 and the biasing member 40 are separately arranged.

The reaction force mechanism 252 and the biasing member 40 are provided facing the cylinder 2 across the fulcrum pin 252. The reaction force mechanism 252 introduces the pilot pressure p from the control passage 28 to the reaction force chamber 42 via the feedback passage 44. By the working force in the reaction force chamber 42, a reaction force counteracting the weight of the body to be carried 1 is generated. The control valve 38 can be switched to one of the open valve position 38*a* and the closed valve position 38*b* by a rock of the leverage member 254. In this case as well, the control valve 38 operates in the same manner as the aforementioned weight pressure converter 36. In FIG. 11, the control valve 38 is a normal open type, and a relation between the open valve position 38*a* and the closed valve position 38*b* is in reverse to that of a normal close type as shown in FIG. 6A.

Figure 12:
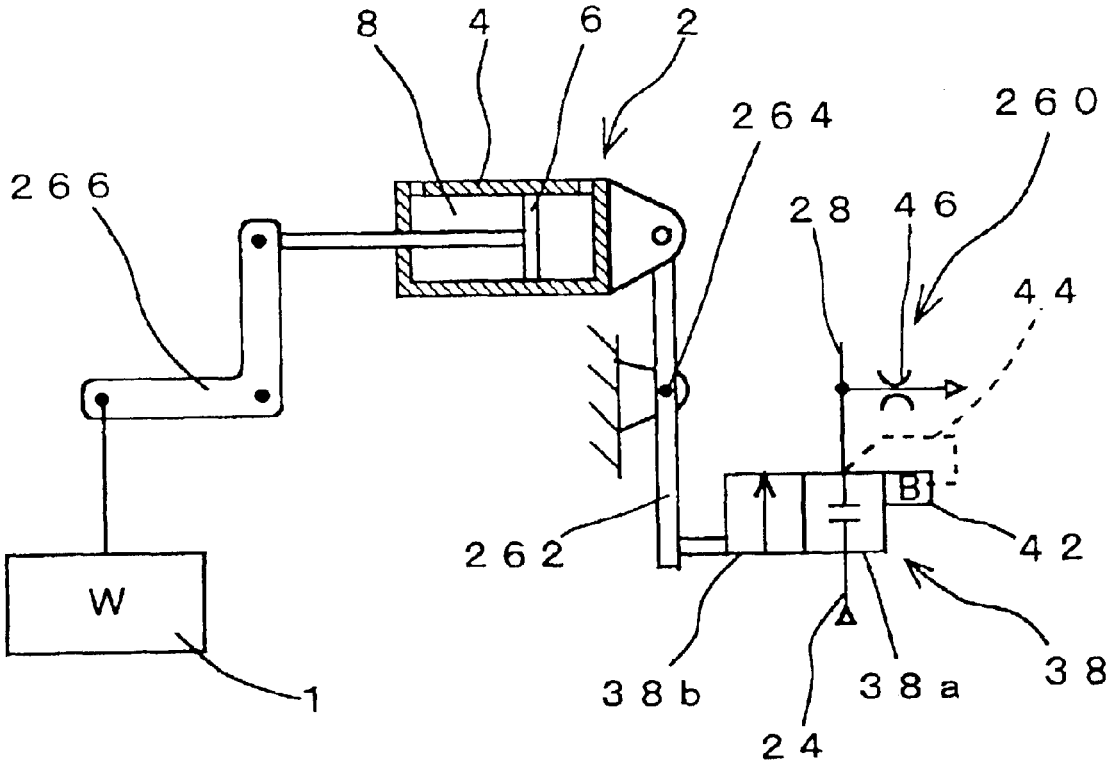
FIG. 12 is a diagrammatic representation of a relevant part of an air balancing device comprising a horizontally arranged cylinder of another embodiment.

If the components are arranged as in FIG. 12, the air balancing device of the present invention can operate without providing the aforementioned biasing member 44 to the weight pressure converter 260. In this case, the cylinder 2 is arranged horizontally, and the cylinder tube 4 is attached to one end of a standing leverage member 262. The leverage member 262 is supported rockably around a fulcrum pin 264, and the weight pressure converter 260 is arranged on the opposite side to the cylinder tube 4 across the fulcrum pin 264. The body to be carried 1 is hangingly supported to one end of a lever member 266 rockably supported, and the rod of the cylinder 2 is connected to the other end of the lever member 266. Thereby, the weight of the cylinder 2 is not applied to the weight pressure converter 260, and the biasing member 44 is not necessary.

Figure 13:
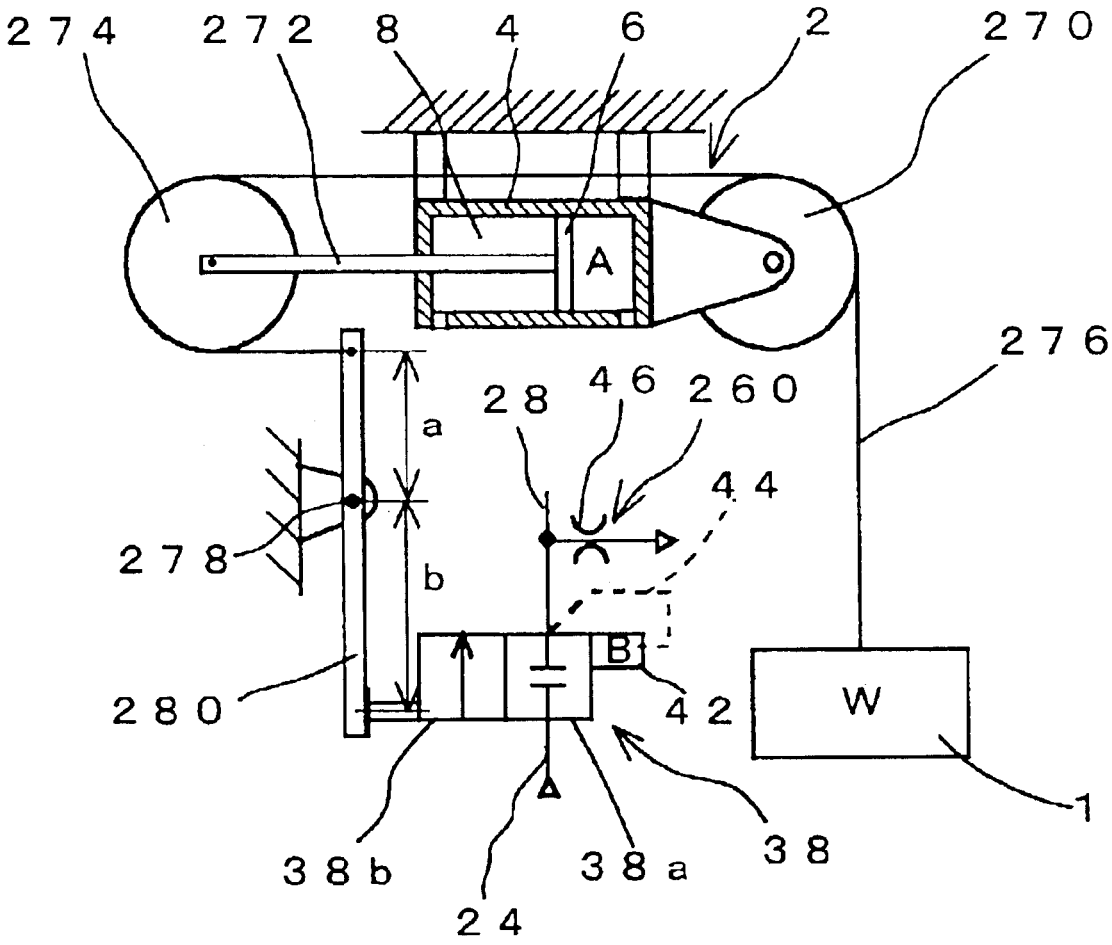
FIG. 13 is a diagrammatic representation of a relevant part of an air balancing device comprising a horizontally arranged cylinder and pulleys of another embodiment.

The weight pressure converter 260 does not require the biasing member 44 even in the arrangement as shown in FIG. 13. In this case, the cylinder 2 is horizontally arranged, and the cylinder tube 4 is fixed to a base. A pulley 270 is rotatably supported to the cylinder tube 4, and a pulley 274 is rotatably supported to a rod 272. The body to be carried 1 is hung from one end of a rope 276 stretched between the pulleys 270 and 274, and the other end is tied to one end of a leverage member 280 supported rockably around a fulcrum pin 278.

The weight pressure converter 260 is arranged at the other end of the leverage member 280. In this case as well, the weight of the cylinder 2 is not applied to the weight pressure converter 260, and the biasing member 44 is not necessary. The following equation is established in this case.

$$B=(a/2b)\times A$$

The present invention should not be limited to the described embodiments, and other modifications and variations might be possible without departing from the scope of the invention.

Industrial Availability

As described in details in the above, an air balancing device of the present invention is less affected by sliding resistance of cylinder packing. Therefore, less force is required for raising and lowering a body to be carried, and an easy operation is realized.

What is claimed is:

1. An air balancing device for balancing a working force of a piston of a cylinder with a weight of a body to be carried, comprising a pressure regulating valve for adjusting a pressure in a supply/discharge passage to a pressure balanced against the weight of the body to be carried, the supply/discharge passage being connected to a working chamber of the cylinder for raising and lowering the body to be carried, the air balancing device further comprising a control valve for increasing and decreasing a pressure in a control passage in accordance with a balance between the weight of the body to be carried and a working force in a reaction force chamber to which a pilot pressure is introduced from the control passage, the pressure regulating valve comprising a pressure regulating chamber connected to the control passage via an opening/closing valve, a pilot chamber to which the pilot pressure from the control passage is constantly introduced, and a control chamber to which a pilot pressure from the supply/discharge passage is introduced, the pressure in the supply/discharge passage being adjusted to a pressure balanced against the weight of the body to be carried in accordance with a balance between a working force in the pressure regulating chamber and working forces in the pilot chamber and the control chamber.

2. The air balancing device as set forth in claim 1, further comprising a leverage member rockably supported, to which said cylinder hanging said body to be carried is attached, wherein the pressure in said control passage is adjusted by having the working force in the reaction force chamber operate on the leverage member to a direction counteracting the weight of the body to be carried, and also by opening and closing said control valve as a result of a rock of the leverage member.

3. The air balancing device as set forth in claim 1, further comprising a biasing member which is balanced with the weight of the cylinder.

* * * * *